United States Patent [19]

Donofrio

[11] 4,139,043

[45] Feb. 13, 1979

[54] WINDOW SHADE SLAT

[75] Inventor: John D. Donofrio, Ogdensburg, N.Y.

[73] Assignee: Joanna Western Mills Company, Chicago, Ill.

[21] Appl. No.: 776,298

[22] Filed: Mar. 10, 1977

[51] Int. Cl.[2] ..... E06B 9/00

[52] U.S. Cl. ..... 160/236; 160/263

[58] Field of Search ..... 160/236, 263, 250, 323, 160/324–326; 52/98, 99, 100; 229/93; 428/43; 138/DIG. 11, 129, 178, 119; 93/94 R, 80, 81, 82, 77 R; 206/602, 620, 820; 70/422

[56] References Cited

U.S. PATENT DOCUMENTS

| | | | |
|---|---|---|---|
| 1,680,341 | 8/1928 | Rosenthal | 138/119 |
| 1,919,568 | 7/1933 | McCosh | 52/98 |
| 2,483,560 | 10/1949 | Peterson | 52/99 |
| 3,086,586 | 4/1963 | Wolfe | 160/236 |
| 3,485,147 | 12/1969 | Hurst | 93/94 R |
| 3,789,904 | 2/1974 | Takazawa | 160/263 |
| 3,821,829 | 7/1974 | Finnerty | 428/43 |
| 3,933,401 | 1/1976 | Lampe et al. | 428/43 |

*Primary Examiner*—Peter M. Caun

*Attorney, Agent, or Firm*—Bean, Kauffman & Bean

[57] ABSTRACT

A window shade in combination with a slat made easily adjustable in length by the inclusion of regularly spaced transverse lines of weakness in the ends thereof. The window shade slat preferably consists of a flattened, convolutely or spirally wound, thickwalled, small diameter paper tube.

5 Claims, 5 Drawing Figures

10
12
20

30

30
12
a a

WINDOW SHADE SLAT

BACKGROUND OF THE INVENTION

The present invention relates to window shade slats provided for insertion into the bottom hem pocket of a window shade in order to keep the shade straight and for providing a rigid hand-hold to raise or lower the shade. More specifically, the present invention relates to an adjustable width window shade slat which may be easily shortened by the user in the home without the use of any tools, by manually breaking the end of the slat off at predetermined lines of weakness in order to substantially conform the length of the slat to the length of the hem pocket. More specifically still, the present invention relates to an adjustable length window shade slat made from a uniquely formed convolutely or spirally wound paper tube.

The utilization of longitudinally extending slats, such as wooden slats, for the purpose of insertion into a hem pocket at the bottom of the window shade in order to provide a means for keeping the shade straight and as a means for grasping the shade is well known. Traditionally, such wooden slats are sold with the window shade and are not readily adjustable by the user. Ordinarily, both shade and slat are cut in the store for the customer so that the customer must have prior information with respect to the precise width to which the window shade should be cut.

The equipment in the store for cutting window shades to width include a special window shade cutting machine and a special snipping device used to snip off the excess width of the window shade slat after the width of the window shade itself has been reduced. Sales personnel must be available to operate the equipment to the customer's specifications. However, it is not always clear to the customer how to make the required measurements so that in many cases the measurement which the sales personnel uses in operating the cutting machine is incorrect with the result that the shade and slat are cut to an improper width. If the measurement is recognized to be inadequate, the customer must return home and retake the measurement before the shade and slat can be correctly cut.

Recent advances in the art of adjustable width window shades and window shade rollers have been made which provide window shades and rollers which are readily adjusted in width in the home by the customer, thereby dispensing with the need to premeasure the size of the window and to rely on the availability and competence of the sales personnel. Such an advance is disclosed in co-pending patent application Ser. No. 723,781 filed Sept. 16, 1976 in the name of John D. Donofrio entitled SHADE ROLLER ASSEMBLY, and assigned to the assignee of the present invention. The present adjustable width window shade slat completes the width adjustability of the window shade assembly as a whole in an inexpensive manner which makes it possible for the homeowner to make all the width adjustments at home without the use of special tools.

SUMMARY OF THE INVENTION

The window shade slat according to the invention comprises a longitudinally extending slat which may be of any suitable material such as wood or plastic, containing spaced transverse lines of weakness at one or both ends thereof. These spaced transverse lines of weakness permit the slat to be selectively shortened by breaking or otherwise separating the slat along one of the lines of weakness.

In its preferred embodiment, the window shade slat consists of a spirally or convolutely wound cylindrical paper tube with a relatively heavy wall and a small external diameter, which tube is substantially flattened during manufacture so as to resemble in shape the cross-section of the commonly used wooden window shade slats. The spirally or convolutely wound flattened paper tube may be scored or cut or otherwise weakened such as by the inclusion of stamped depressions at regularly spaced intervals during the manufacturing process. In this manner, the flattened paper tube window shade slat is also subject to separation such as by tearing or breaking in order to conveniently shorten the slat to a desired width.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DETAILED DESCRIPTION

Figures 1, 2, 3, 4:
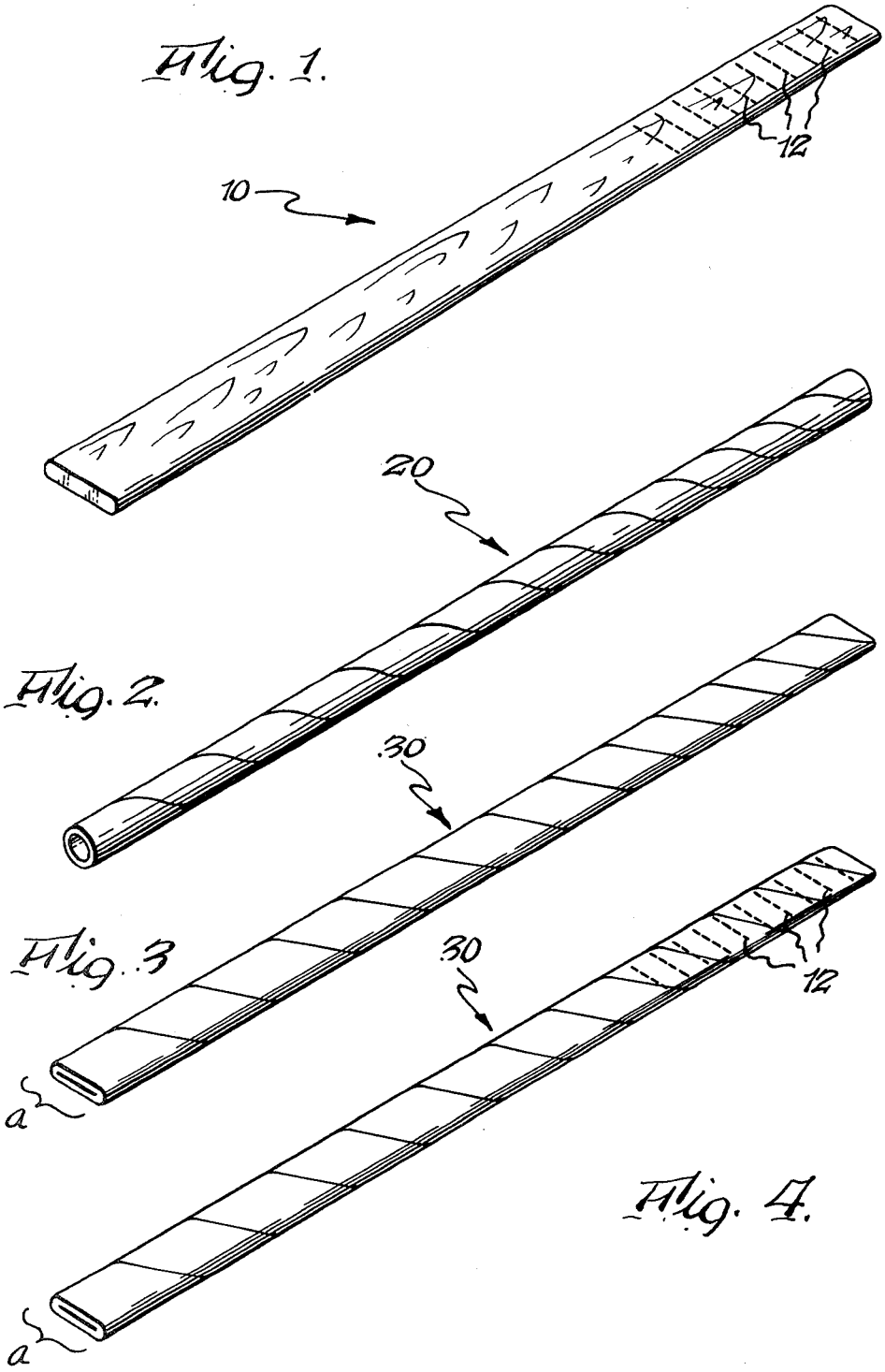
FIG. 1 is a representation of a wooden slat of conventional form but having transverse lines of weakness at one end.
FIG. 2 is a representation of a convolutely or spirally wound paper tube during its final stage of manufacture and just prior to being flattened for use as a window shade slat.
FIG. 3 is a representation of a flattened convolutely or spirally wound paper tube window shade slat.
FIG. 4 is a representation of the slat of FIG. 3 further including transverse lines of weakness at one end thereof for permitting the easy adjustment of the width of the slat.

Referring now to FIG. 1, an adjustable width window shade slat 10 is disclosed comprising a wooden slat having a first width and including regularly spaced lines of weakness 12 at one end. Each of the lines of weakness 12 define tear or break lines at which the window shade slat 10 may be broken or otherwise separated into a window shade slat having a shortened second length and a separated broken off element. Transverse lines of weakness 12 are of such a nature or of such a depth as to weaken the slats 10 to the point where the slat may readily be broken as desired. With such an arrangement, the window shade slat 10 as disclosed may be selectively shortened by breaking or otherwise separating in the home by the housewife or other user. It should be apparent that the lines of weakness for separation could be provided at either or both ends of the slat.

Referring now to FIG. 2, a heavy wall small diameter tube 20 is shown which is ideally suited for use as a strong, inexpensive, easily manufactured window shade slat. Tube 20 consists of a convolutely or spirally wound paper tube of circular cross-section which has been made by conventional techniques with adhesive between the paper layers.

After the tube 20 has been wound with suitable adhesive between the paper layers, it is flattened and held as long as is necessary for the preferred, flattened shape of FIG. 3 to be retained. This flattening step desirably is accomplished while the materials forming the tube are still pliable in order that splitting along the fold be avoided. As may be understood, the paper tube 20 may be made with any of a variety of different types of adhesives. Thus, the period of time required in the holding step will be dependent on the particular adhesive and the particular "setting" or "curing" method used.

Figure 5:
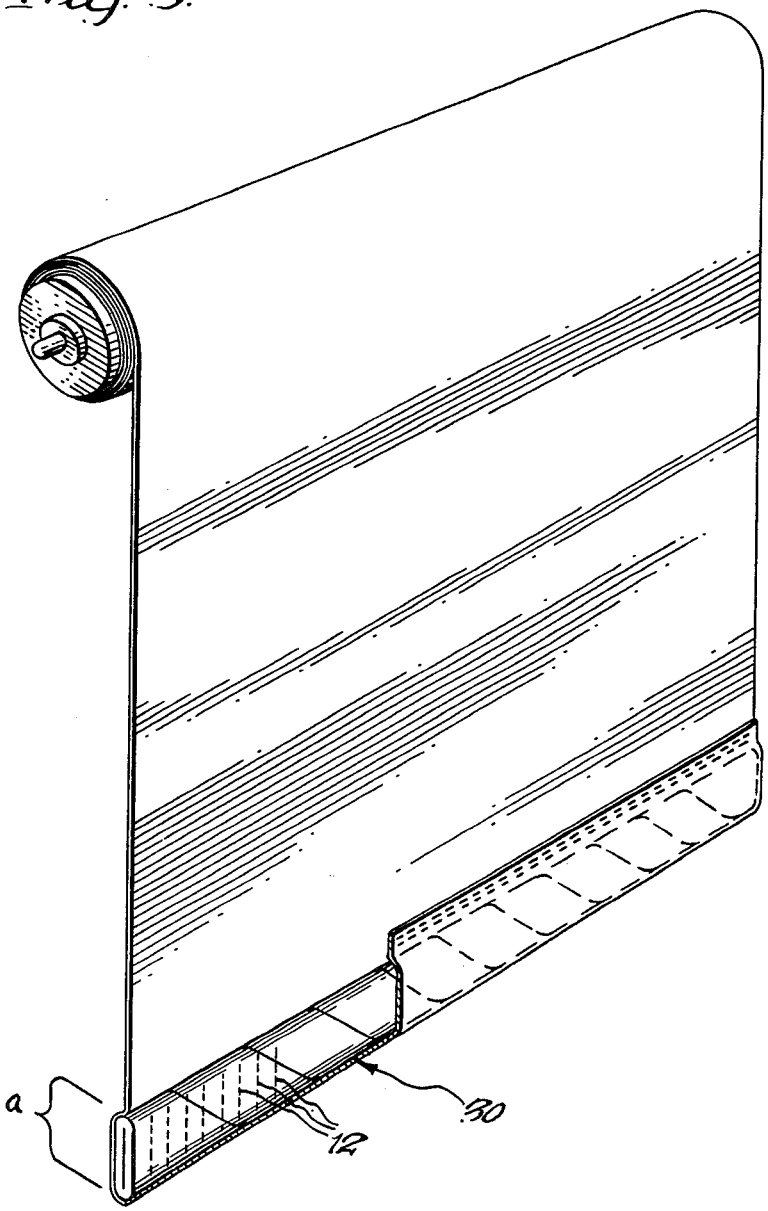
FIG. 5 is an illustration of the slat shown in FIG. 4 in combination with a window shade having a hem pocket for receiving the slat.

In this manner, an excellent, relatively inexpensive window shade slat 30 is produced. Such a slat 30 has the advantage of increased strength relative to a cylindrical paper tube since the pulling and bending forces applied to the flattened slat 30, when the slat 30 is in the hem pocket of a window shade as shown in FIG. 5, are applied along the direction of the thickest part (a) of the slat. Thus, where a cylindrical tube might possibly fold and crumple, the flattened convolutely or spirally wound paper tube of the present invention will retain its original shape and stiffness.

Finally, FIG. 4 illustrates the flattened convolutely or spirally wound paper tube 30 with end serrations or transverse lines of weakness 12 inscribed, cut or otherwise formed therein. The flattened paper tube 30 may be provided with these lines of weakness 12 at any convenient point in the method of manufacture by any convenient technique. Thus, the lines of weakness 12 may be pressed into the tube during the flattening and holding steps. Alternatively, the lines of weakness may be cut into the tube 30 by a cutting machine either before or after the adhesive in the tube has completed its "set" or "cure".

While the construction of the present window shade slat is particularly adapted to facilitate shortening of the width of a window shade slat in the home by the user, it will of course be understood that the present assembly is also adapted to machine trimming by a dealer if a user should so desire.

What is claimed is:

1. An improved window shade of the type having in combination a sheet of shade material with a hem pocket along the lower edge adapted for receiving therein a shade slat and a shade slat inserted within said hem pocket, wherein the improvement comprising a window shade slat which comprises a permanently flattened thick-walled, multi-layered, convolutely or spirally wound paper tube having substantial resistance to bending distortion in the direction of its greatest flattened thickness.

2. The window shade slat as recited in claim 1 having one end including spaced transverse lines of weakness, whereby said window shade slat may be selectively shortened by separating said slat along one of said lines of weakness.

3. The window shade slat as recited in claim 2 wherein said lines of weakness are spaced at regular intervals.

4. The window shade slat as recited in claim 2 wherein said lines of weakness include regularly spaced cuts in the surface of said flattened tube.

5. The window shade slat as recited in claim 2 wherein said lines of weakness include regularly spaced depressions pressed into the surface of said flattened tube.

* * * * *